United States Patent [19]

Jankot

[11] 4,076,451

[45] Feb. 28, 1978

[54] CERAMIC TURBINE STATOR

[75] Inventor: Alan Lewis Jankot, South Glastonbury, Conn.

[73] Assignee: United Technologies Corporation, Hartford, Conn.

[21] Appl. No.: 664,129

[22] Filed: Mar. 5, 1976

[51] Int. Cl.[2] ..... F04D 29/02

[52] U.S. Cl. ..... 415/217; 415/200; 415/208

[58] Field of Search ..... 415/217, 214, 216, 219 R, 415/136, 139, 200, 208; 416/207, 208, 180, 218, 241 B

[56] References Cited

U.S. PATENT DOCUMENTS

| | | | |
|---|---|---|---|
| B 552,006 | 2/1976 | Booher, Jr. | 415/214 |
| B 563,412 | 2/1976 | Booher, Jr. | 415/214 |
| 2,801,076 | 7/1957 | Terrell et al. | 415/200 |
| 3,025,037 | 3/1962 | Beckstrom | 416/241 B |
| 3,042,366 | 7/1962 | Holmquist | 416/241 |
| 3,074,690 | 1/1963 | Henny | 415/136 |
| 3,192,862 | 7/1965 | Schrader, Jr. | 416/180 |
| 3,857,649 | 12/1974 | Schaller et al. | 415/217 |
| 3,867,065 | 2/1975 | Schaller et al. | 415/214 |
| 3,905,723 | 9/1975 | Torti, Jr. | 415/214 |
| 3,910,716 | 10/1975 | Roughgarden | 415/217 |

*Primary Examiner*—C. J. Husar

*Attorney, Agent, or Firm*—Robert C. Walker

[57] ABSTRACT

A turbine stator assembly which is adapted for long term, reliable operation in the high temperature environment of a gas turbine engine is disclosed. Various construction details and material selections are discussed. The system cooperatively employs varied increments of component thermal expansion to hold ceramic vanes in compression throughout the operating cycle of the engine.

12 Claims, 3 Drawing Figures

CERAMIC TURBINE STATOR

BACKGROUND OF THE INVENTION

1. Field of the Invention

This invention relates to stator assemblies for gas turbine engines and particularly to assemblies having ceramic vanes.

2. Description of the Prior Art

Scientists and engineers practicing within the turbine engine field have long recognized that ceramic materials are generally more compatible with the high temperature fluids of gas turbine engines than are conventional metallic materials. They have also recognized that the stator vanes of the turbine section are among the most susceptible of engine components to thermal and chemical degradation. It is, therefore, that a continuing search has been underway for structures which effectively integrate ceramic material and gas turbine technologies to provide turbines having increased durability.

Collaterally, increasing emphasis on the effective use of energy resources is making performance demands on turbine machinery which do not appear to be within the capacity of conventional metallic structures to obtain. Sharply elevated turbine inlet temperatures are requiring cooling systems of increasing capacity and complexity. Such systems siphon substantial working medium fluids from the flow path of the machine. The siphoned fluids are unavailable for work upon the reaction surfaces of the machine and lower engine performance results.

Prior to the concepts described herein, no commercially suitable combination of ceramic material and turbine technologies has been advanced. Of the concepts proposed, however, U.S. Pat. No. 3,867,056 to Schaller et al entitled "Ceramic Insulator for a Gas Turbine Blade Structure" is representative of numerous ceramic techniques which were heretofore known within the art. In particular, note should be taken of FIG. 1 of Schaller wherein the ceramic blades extend radially between an inner metallic shroud 22 and an outer metallic shroud 26 to form a stator assembly. The ceramic blades replace more conventional metallic blades to improve the thermal compatibility of the stator assembly with the hot gas of the flow path extending therethrough. Schaller et al. further teaches that the shroud and vane assemblies be segmented. (See column 1, line 62 and column 2, line 2.) In this respect, the typical prior art structure, as represented by Schaller, is conceptually and structurally distinct from the concepts of the present invention which are discussed in detail later in this disclosure.

Certain ceramic material concepts previously known within the art are also beneficially employed within the structure of the present invention. Specifically, ceramic materials are known to have their greatest strength under compressive, as distinguished from tensile or bending loads. U.S. Pat. No. 2,855,179 to Brown entitled "High Temperature Ceramic Turbine" is illustrative of one technique for holding ceramic rotor blades in compression. It is readily apparent, however, that centrifugal force techniques for applying compressive loads to the ceramic blades in Brown are inapplicable to stationary structure such as the stator vane assembly discussed herein.

Continuing efforts are underway to make the benefits of ceramic stator materials available for use within the turbine environment of a gas turbine engine.

SUMMARY OF THE INVENTION

A primary object of the present invention is to improve performance in a gas turbine engine. An increase in the thermal capability of the turbine components while maintaining adequate durability is one goal. Concurrently, a decrease in the amount of cooling air required by the turbine is sought.

According to the present invention a turbine stator assembly for a gas turbine engine is formed of a plurality of radially extending ceramic vanes which are circumferentially spaced between a metallic, continuous inner shroud and a metallic, continuous outer shroud wherein the shrouds are responsive to increased turbine temperatures in a manner holding the ceramic vanes in radial compression throughout the engine operating cycle.

A primary feature of the present invention is the ceramic vanes of the turbine stator assembly. The vanes are trapped between a metallic, continuous inner shroud and a metallic, continuous outer shroud. The coefficients of expansion of the shroud materials are matched with their respective shroud environments so as to hold each vane in radial compression throughout the engine operating cycle. In one embodiment each vane is supported at the inner shroud and at the outer shroud by a ball and socket type joint. The outer shroud is flexibly attached to the engine outer case thereby isolating the outer shroud from radial distortions of the outer engine case. In another embodiment, the inner shroud is flexibly attached to the engine inner case thereby isolating the inner shroud from radial distortions of the inner engine case. Fingers extend axially from the inner shroud and from the outer shroud to grip the vane platforms without imparting significant bending moments to the vanes during conditions of axial misalignment between the inner and the outer shrouds.

A principal advantage of the present invention is the improved turbine durability provided by the ceramic vanes and their attendant support structure. The vane material is thermally compatible with the turbine environment, thus eliminating vane cooling requirements. The elimination of cooling requirements increases the amount of fluid medium available for turbine work. The vane material collaterally offers improved resistance to chemical degradation when compared to metallic structures. The susceptability of the vanes to stress fracture is reduced by the specific construction disclosed which holds the ceramic vanes in radial compression throughout the engine operating cycle without imparting significant indeterminant loads to the vanes.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
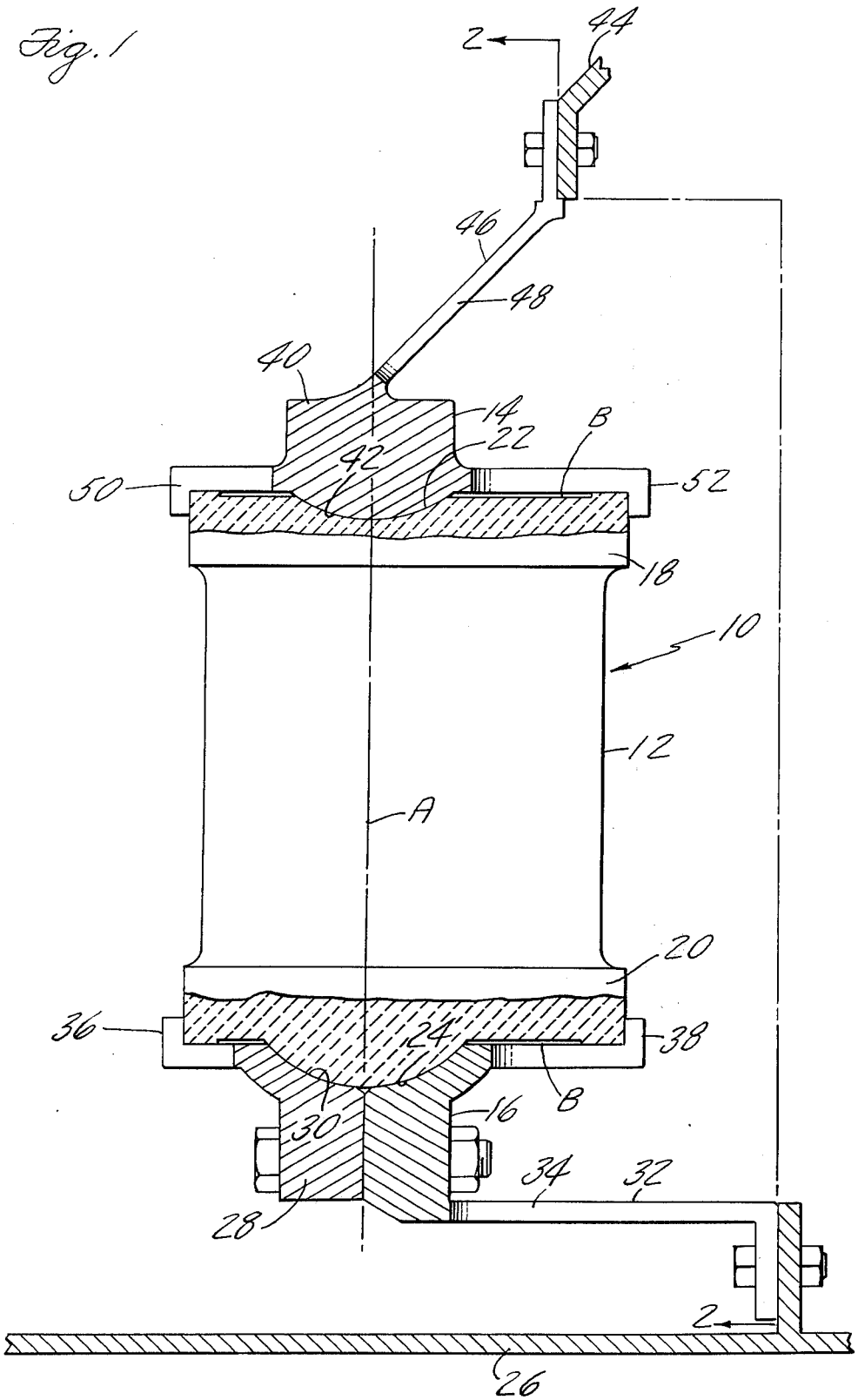
FIG. 1 is a simplified cross section view of a turbine stator assembly having ceramic vanes incorporated therein.

A stator vane assembly 10 within the turbine section of a gas turbine engine is shown in cross section in FIG. 1. A plurality of stator vanes as represented by the single vane 12 extend radially between an inner shroud 14 and an outer shroud 16. Each stator vane has an inner diameter platform 18 and an outer diameter platform 20. The inner diameter platform has incorporated therein an inwardly facing socket 22 having a spherical contour. The outer diameter platform has an outwardly facing, spherical surface 24.

The outer shroud 16 is axially affixed to an outer, turbine case 26. The outer shroud has a continuous, central ring portion 28 having a spherical socket 30 which is engaged by the spherical surface 24 of the vane 12. Extending between the ring portion 28 and the outer case 26 is a cylindrical support 32. The cylindrical support has incorporated therein a plurality of axially extending slots 34 to increase the radial flexibility of the support. A plurality of upstream fingers 36 and a plurality of downstream fingers 38 extend from the central ring portion 28 of the outer shroud 16 to grip the outer diameter platform 20 of the vane 12. The outer diameter shroud in the embodiment shown is split to enable assembly of the structure.

The inner shroud 14 has a continuous central ring portion 40 including incorporated therein an outwardly facing spherical surface 42 which engages the inwardly facing socket 22 of the inner diameter platform 18. Extending inwardly from the central ring portion to an inner, turbine case 44 is a truncated conical support 46. The conical support has slots 48 which are incorporated therein to increase the radial flexibility of the conical support. A plurality of upstream fingers 50 and a plurality of downstream fingers 52 extend from the central ring portion of the inner shroud to grip the inner diameter platform 18 of the vane 12.

Figure 2:
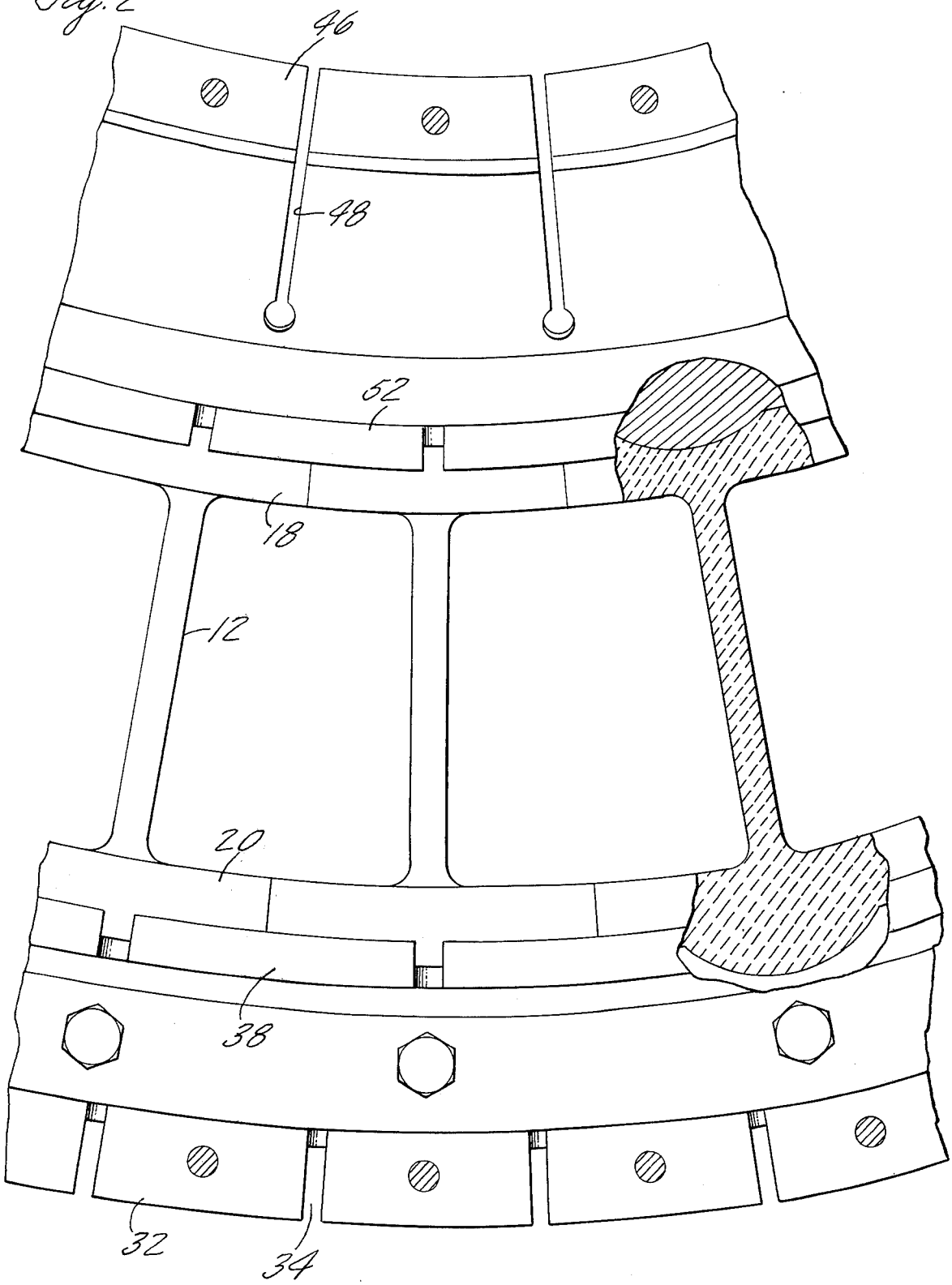
FIG. 2 is a directional view taken along the line 2—2 as shown in FIG. 1.
Figure 3:
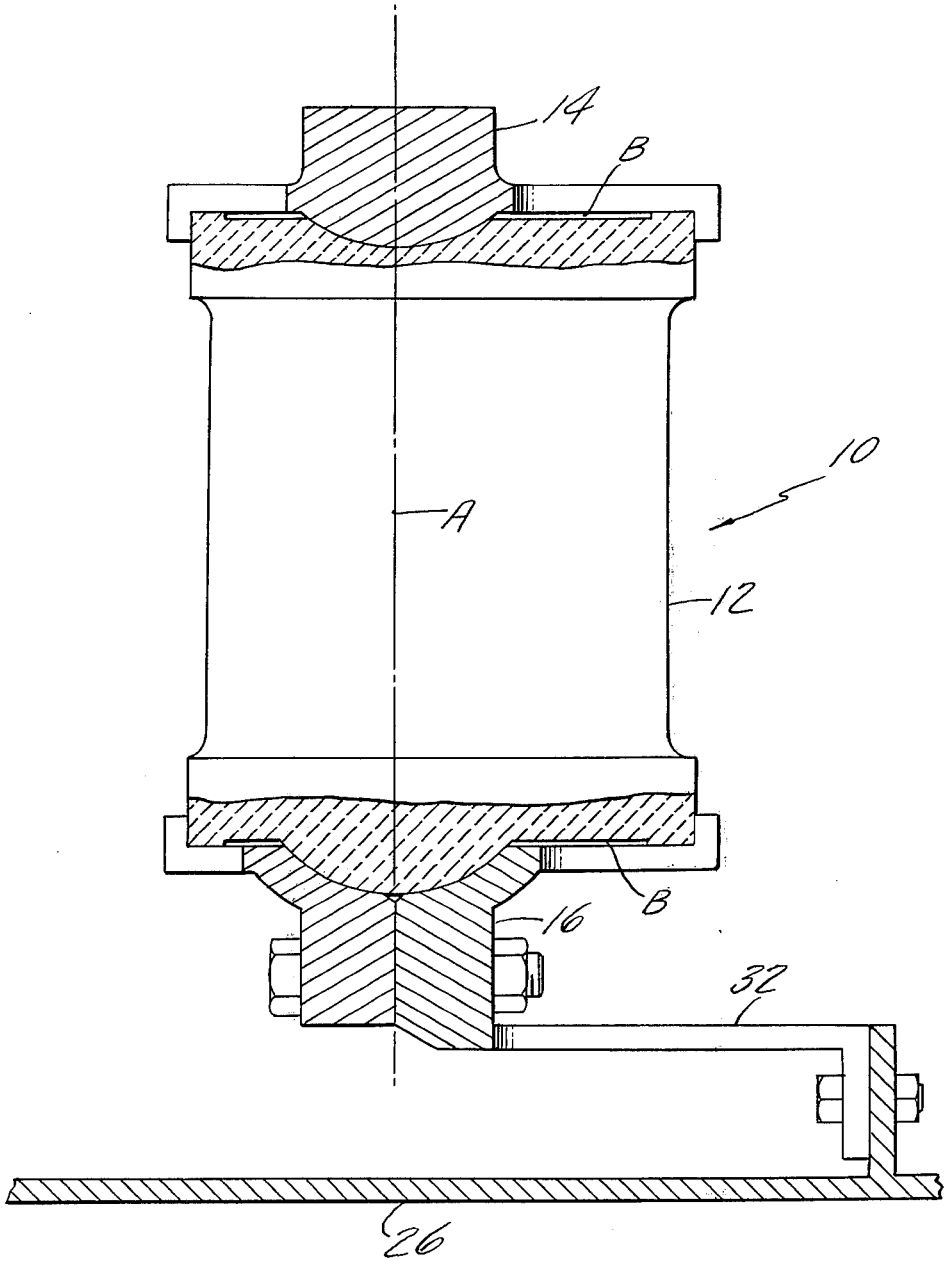
FIG. 3 is a simplified cross section view of an alternate turbine stator assembly wherein the assembly is cantilevered from the outer engine case.

The axial slots of the truncated conical support 46 and the cylindrical support 32 are more clearly viewable in FIG. 2. In an alternate embodiment, as is shown in FIG. 3, the vane assembly 10 is cantilevered from the outer case 26. The inner shroud 14 is free of the axial restraint which was provided by the truncated conical support 46 shown in FIG. 1.

The ceramic material from which the vanes 12 are fabricated has been selected for thermal compatibility with the hot medium gases of the engine flow path. An additional benefit gained through the use of ceramic materials is the improved resistance of the stator assembly to chemical degradation. This improved resistance is particularly advantageous in engines burning higher sulfur fuels and in engines operated within marine environments. Two ceramic materials which are known to be suitable are silicon nitride and silicon carbide, although numerous other ceramic materials having similar characteristics and properties may be utilized to provide other effective embodiments of the invention.

The ceramic vanes, although disposed across the flow path of the hot engine gases, are not cooled. The ability of the vanes to survive in this hostile environment without elaborate and complex cooling systems substantially reduces the cost of the stator assembly over the cost of a comparable assembly incorporating metallic vanes. Perhaps the greatest advantage, however, is the performance increase made possible by reducing the amount of working medium fluids which are diverted from the reaction surfaces of the engine to cooling conduits in chambers within the stator assembly.

As has been discussed in the prior art section of this specification, ceramic composed articles exhibit their greatest strength under compressively loaded conditions. The shroud structure of the preferred embodiments described herein is specifically adapted to place the ceramic vanes in radial compression throughout the engine operating cycle. The inner shroud, which is a continuous ring, is fabricated from a material having a greater coefficient of thermal expansion than the material from which the outer shroud, also a continuous ring, is fabricated. As temperatures increase within an operating engine, the inner shroud grows radially outward toward the outer shroud. The ceramic vanes trapped between the inner and outer shroud are thereby compressed between the expanding inner and outer shrouds.

In the FIG. 1 embodiment the ceramic vanes are simply supported at each end between the inner shroud 14 and the outer shroud 16. The inner shroud is axially positioned by the inner turbine case 44 acting through the truncated conical support 46. The outer shroud is axially positioned by the outer turbine case 26 acting through the cylindrical support 32. Both the cylindrical support and the truncated conical support are axially slotted to reduce the radial structural influence of the inner and outer case on the vane assembly. The axial slots 48 of the truncated conical support are readily viewable in FIG. 2. The axial slots 34 of the cylindrical support are also shown though not as readily viewable due to the cylindrical orientation of the support into which they are incorporated. This radial flexibility of the supports frees the stator assembly from distortions of the inner and outer engine cases as these cases respond to thermal stimuli.

Relative axial displacement between the inner shroud 14 and the outer shroud 16 is accommodated by the ball and socket type joints through which the ceramic vanes are affixed to the stator assembly. The upstream and downstream fingers of the inner shroud and the upstream and downstream fingers of the outer shroud grip the ceramic vanes securely while accommodating misalignment of the vanes within the assembly. The fingers gripping each vane operate independently of the adjacent fingers so as to hold each vane securely while imparting only minimal loads to the ceramic vane.

The airfoil stacking line A is shown in FIG. 1 and in FIG. 3. The direction of compressive forces within the vane runs substantially parallel to the airfoil stacking line throughout the engine operating cycle, notwithstanding axial misalignment of the inner and outer shrouds.

An alternate construction is shown in FIG. 3 wherein the stator assembly is cantilevered from the outer case 26. Cantilevering the vane assembly as shown in FIG. 3 substantially eliminates axial misalignment between the inner shroud 14 and the outer shroud 16 and may be a preferable embodiment at some stator assembly location.

The ball and socket joints described herein are considered to be effective means for imparting the compressive loads to the ceramic vanes although other types of joining techniques will also prove effective. Those skilled in the art will also recognize that the sockets of the ball and socket joints may be in reverse positions to those shown in FIG. 1.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. A stator vane assembly, which includes:

an inner, continuous shroud having a central ring portion including a spherical surface facing outwardly therefrom;

an outer, continuous shroud having a central ring portion including a spherical socket facing inwardly therefrom; and a ceramic vane disposed radially between said inner and said outer shrouds wherein the vane has an inner diameter platform which is engaged by the spherical surface of the inner shroud and an outer diameter platform which is engaged by the spherical socket of the outer shroud.

2. The invention according to claim 1 wherein said inner shroud is fabricated from a material having a greater coefficient of thermal expansion than the material from which said outer shroud is fabricated.

3. The invention according to claim 1 wherein said outer shroud is comprised of a first element and an axially adjacent second element which are separable to facilitate assembly of said ceramic vane in the stator assembly.

4. The invention according to claim 2 wherein said outer shroud is affixed to an outer engine case by a cylindrical support.

5. The invention according to claim 4 wherein said cylindrical support is axially slotted to increase its radial flexibility and to thermally isolate said outer shroud from the outer case.

6. The invention according to claim 5 wherein said inner shroud is affixed to an inner engine case by a truncated conical support.

7. The invention according to claim 6 wherein said truncated conical support is axially slotted to increase its radial flexibility and to thermally isolate said inner shroud from the inner engine case.

8. The invention according to claim 7 wherein said inner shroud has extending therefrom an upstream finger and a downstream finger which encase the inner diameter platform of the ceramic vane.

9. The invention according to claim 8 wherein said fingers of the inner shroud are radially flexible to accommodate angular misalignment of said vane with respect to the inner shroud.

10. The invention according to claim 9 wherein said outer shroud has extending therefrom an upstream finger and a downstream finger which encase the outer diameter platform of the ceramic vane.

11. The invention according to claim 10 wherein said fingers of the outer shroud are radially flexible to accommodate angular misalignment between the vane and the outer shroud.

12. The invention according to claim 1 which comprises a plurality of said ceramic vanes in circumferentially spaced relationship between said outer shroud and said inner shroud.

* * * * *

UNITED STATES PATENT OFFICE

CERTIFICATE OF CORRECTION

PATENT NO. : 4,076,451

DATED : February 28, 1978

INVENTOR(S) : ALAN LEWIS JANKOT

It is certified that error appears in the above-identified patent and that said Letters Patent are hereby corrected as shown below:

After the ABSTRACT, the following paragraph should be inserted:

--The Government has rights in this invention pursuant to Contract No. N00019-74-C-0354 awarded by the Department of the Navy. --

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*